US006887331B2

(12) United States Patent
Löcher et al.

(10) Patent No.: US 6,887,331 B2
(45) Date of Patent: May 3, 2005

(54) METHOD AND DEVICE FOR PRODUCING A SPUNBONDED NONWOVEN FABRIC

(75) Inventors: Engelbert Löcher, Worms (DE); Michael Hess, Trippstadt (DE)

(73) Assignee: Firma Carl Freudenberg, Weinheim (DE)

( * ) Notice: Subject to any disclaimer, the term of this patent is extended or adjusted under 35 U.S.C. 154(b) by 292 days.

(21) Appl. No.: 09/911,730

(22) Filed: Jul. 24, 2001

(65) Prior Publication Data

US 2002/0043739 A1 Apr. 18, 2002

(30) Foreign Application Priority Data

Jul. 25, 2000 (DE) ..... 100 36 047

(51) Int. Cl.[7] ..... D04H 3/05; B32B 31/00

(52) U.S. Cl. ..... 156/167; 156/180; 156/181; 156/296; 156/433; 156/441

(58) Field of Search ..... 156/167, 180, 156/181, 296, 433, 441, 166

(56) References Cited

U.S. PATENT DOCUMENTS

| | | | | |
|---|---|---|---|---|
| 3,030,659 A | | 4/1962 | Slayter | |
| 3,293,718 A | | 12/1966 | Sheets | |
| 3,720,361 A | | 3/1973 | Nommensen | |
| 4,064,605 A | | 12/1977 | Akiyama et al. | |
| 4,285,452 A | * | 8/1981 | Reba et al. | 19/299 |
| 4,753,698 A | | 6/1988 | Hartmann et al. | |
| 5,045,271 A | * | 9/1991 | Mente et al. | 19/299 |
| 5,711,970 A | | 1/1998 | Lau et al. | |
| 5,762,857 A | * | 6/1998 | Weng et al. | 264/465 |
| 6,524,521 B1 | * | 2/2003 | Kuroiwa et al. | 264/555 |

FOREIGN PATENT DOCUMENTS

| | | | |
|---|---|---|---|
| AT | 292178 | | 8/1971 |
| DE | 1 303 569 | | 6/1934 |
| DE | 2114854 | | 10/1971 |
| DE | 2114854 A | * | 10/1971 |
| DE | 24 21 401 | | 11/1975 |
| DE | 35 42 660 | | 6/1987 |
| DE | 3807483 | | 11/1988 |
| DE | 39 07 215 | | 11/1989 |
| EP | 1081252 | | 3/2001 |
| EP | 1081262 | | 3/2001 |
| GB | 1219921 | | 1/1971 |
| JP | 45-1077 | | 1/1970 |
| JP | 46-5481 | | 11/1971 |
| JP | 62-223361 | | 1/1987 |
| JP | 4-223133 | | 8/1992 |
| JP | 6-33360 | | 8/1994 |

* cited by examiner

*Primary Examiner*—Jeff H. Aftergut
(74) *Attorney, Agent, or Firm*—Kenyon & Kenyon

(57) ABSTRACT

A method for producing a spunbonded nonwoven fabric by extruding a linear sheet of filaments arranged parallelly side by side in the form of a curtain from a plurality of spinning capillaries, involving aerodynamical pulling off and drawing of the filament sheet, the filament sheet (8) which emerges from the drawing duct (12) or which is pulled off a spool being moved laterally crosswise by an air flow having periodically changing directions, the air flow being oriented alternately at an angle toward the filament sheet (8) as viewed in the horizontal plane.

8 Claims, 5 Drawing Sheets

METHOD AND DEVICE FOR PRODUCING A SPUNBONDED NONWOVEN FABRIC

BACKGROUND OF THE INVENTION

1. Field of the Invention

The present invention relates to various methods and devices for producing spunbonded nonwoven fabrics.

2. Description of Related Art

Thermoplastic polymers which are spun in the molten condition to form fine spun filaments are used as base materials. The extruded filaments are mostly aerodynamically drawn, thus obtaining the desired tenacity. Subsequent to the spinning process, or also with spools being interpositioned, the filaments are deposited on a deposition belt on which they come to rest one over another, forming the spunbonded nonwoven fabric.

German Patent Application DE-AS 1 303 569 describes a method for producing nonwoven fabrics in which the extruded filaments are guided through a duct where they are aerodynamically drawn and subsequently deposited in the form of a nonwoven fabric on a perforated moving support.

To ensure the statistically random deposition of the filaments, a turbulence zone, which supports the crosswise deposition of the filaments, is provided beneath the air guide duct. A very irregular appearance of the nonwoven fabric ensues. A high uniformness of the spunbonded nonwoven fabric is achieved in that several guide ducts are provided one behind the other and in that the filament sheets emerging therefrom are deposited one over another in a layer-like manner to form a nonwoven fabric.

To be able to determine the desired uniformness of the nonwoven fabric and its tenacity in the longitudinal and cross direction, it is known from German Patent Application DE 39 07 215 A1 to design the spinning manifolds together with the filament pull-off device such that they are rotatable. This is also intended to eliminate the disadvantages which arise in the so-called "curtain method" and which can cause individual filaments to overlap in certain regions. In the curtain method, the nonwoven fabric possesses a preferred tenacity in the longitudinal direction, that is in the production direction, while the tenacity values in the cross direction are lower. This is to be compensated for by skewing the spinning manifolds together with the deposition and drawing device.

In addition, it is known from German Patent DE 35 42 660 C2 to achieve a deviation of the air flow beneath the pull-off duct with the aid of a parallelly arranged swivelling device to attain a pendulum motion of the filaments in this manner. The swivelling motion takes place in the moving direction of the deposition belt in the production direction; also usable here are, inter alia, so-called "Coander dishes" as are described, for example, in German Patent DE 24 21 401 C3. However, the provided measures are relatively sluggish so that only slow oscillations of the filament sheet are possible.

SUMMARY OF THE INVENTION

It is an object of the invention to provide a method and an appertaining device for producing a spunbonded nonwoven fabric which makes it possible to achieve a very high uniformness of the nonwoven fabric pattern and distribution of weight per unit area. It is a further object of the invention to provide such a method and device which make it possible for the longitudinal and cross tenacity of the nonwoven fabric to be produced in a preselected manner, for example, the tenacity in the cross direction is intended to be equal to the tenacity in the longitudinal direction.

These and other objects of the invention are achieved by a method for producing a spunbonded nonwoven fabric by extruding a linear sheet of filaments, arranged side by side in parallel, in the form of a curtain from a plurality of spinning capillaries, involving aerodynamical pulling off and drawing of the filament sheet, wherein the filament sheet (8) which emerges from the drawing duct channel (12) or which is pulled off a spool is moved laterally crosswise by an air flow having periodically changing directions, the air flow being oriented alternately at an angle toward the filament sheet (8) as viewed in the horizontal plane. The apparatus of the invention includes a spinning manifold having a plurality of spinning capillaries situated in a row, a cooling air duct and a drawing duct as well as a deposition belt, wherein there is at least one blowing duct (3) which is arranged beneath the drawing duct (12) in front of and/or behind the filament sheet (8), the blowing duct having air-outlet nozzles (10, 11) which are aligned at an angle toward the filament sheet (8) as viewed in the horizontal plane.

BRIEF DESCRIPTION OF THE DRAWINGS

The present invention will be described in greater detail, with reference to the following drawings, wherein.

DETAILED DESCRIPTION OF THE INVENTION

Figure 1:
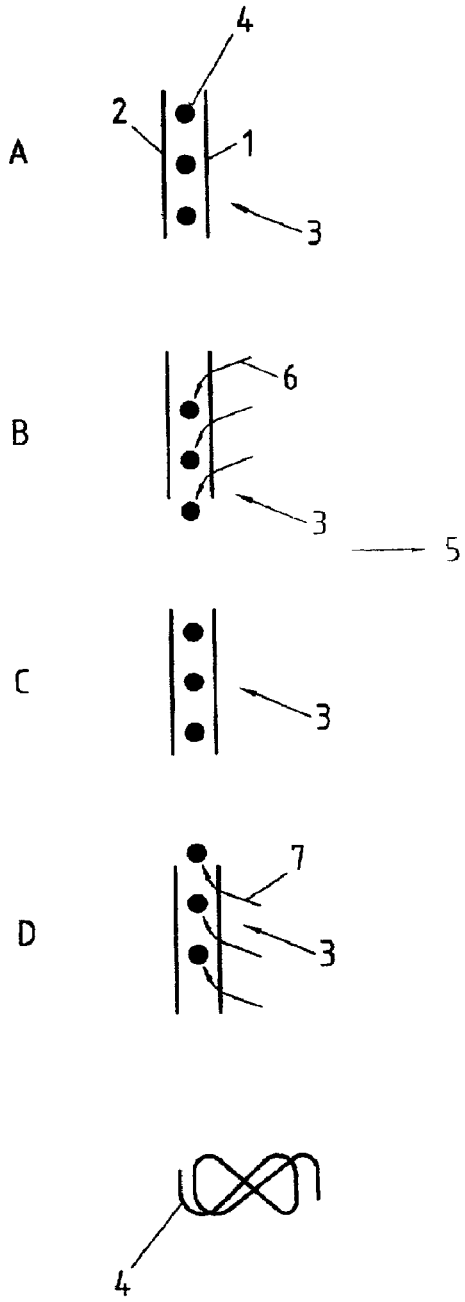
FIG. 1 is a schematic representation of the method sequence according to the invention.

The invention is based on a method for producing a spunbonded nonwoven fabric by extruding a linear sheet of filaments arranged parallelly side by side in the form of a curtain from a plurality of spinning capillaries, involving aerodynamical pulling off and drawing of the filament sheet. According to the present invention, the filament sheet which emerges from the drawing duct or which is pulled off a spool is moved laterally crosswise by an air flow having periodically changing directions, the air flow being oriented alternately at an angle toward the filament sheet as viewed in the horizontal plane. Discrete air puffs in changing directions cause the filament sheet to be moved to and fro crosswise to the production direction, resulting in the desired nonwoven fabric pattern, for example, high uniformness in the pattern.

The air puffs can be alternately carried out from the left and from the right. It has turned out to be advantageous if air pauses are inserted between the individual air flows during which no air puff is present and which allow the filament sheet to align vertically between the air puffs.

The general blow-out direction of the air flows is directed perpendicularly toward the filament sheet. In this context, a blow-out angle of 15° in the horizontal plane is selected. Other blow-out angles are, of course, possible as required. It is also possible for the blow-out direction to be angularly aligned downwards toward the filament sheet in the vertical plane. The blow-out angle in the vertical plane can be 15°.

It is sufficient if the air flows are directed toward the filament sheet from the front face. However, this does not rule out the possibility of directing the air flow toward the filament sheet also from the rear face or from both front sides. This depends, inter alia, on the thickness of the individual filaments and on the existing flow conditions for the air puffs. If necessary, the deposition process can additionally be supported by periodically moving flow-guide surfaces such as swivelling flaps, Coander dishes or the like. As already described in the related art, these are arranged in such a manner that they additionally swing the filament sheet to and fro in the production direction.

The device for carrying out the method is composed of a spinning manifold having a plurality of spinning capillaries situated in a row, having a cooling air duct and a drawing duct as well as a deposition belt. According to the present invention, at least one blowing duct is arranged beneath the drawing duct in front of and/or behind the filament sheet, the blowing duct having air-outlet nozzles which are aligned at an angle toward the filament sheet as viewed in the horizontal plane. The air-outlet nozzles are arranged in such a manner that they can alternately blow an air flow in different directions, namely from the left or from the right as viewed toward the filament sheet. In this context, it is convenient if at least two rows of air-outlet nozzles arranged parallel to each other are provided, the nozzles of one row being aligned inversely to the nozzles of the other row. The air supply to the nozzles is carried out in succession so that, at one time, the air is admitted to the nozzles toward the left and, at another time, to the nozzles toward the right. To this end, the air supply to the nozzles of in each case one row is closed by a closure member. However, it is also possible to provide the nozzles with closure members themselves, and to close the nozzle of one row and to open the other row, respectively.

For closing the nozzles, provision can be made for a rotatable cylinder which has a hollow design and is provided with longitudinal slits.

The nozzles can be formed by corrugated sheet-like inserts which have corrugations running at an angle to their longitudinal direction, and which are inserted in the nozzle wall. They are preferably replaceable so that the volume flow passing through them or also the direction of flow or their angle can be slightly changed.

The nozzle wall is provided with superposed longitudinal slits which correspond to the longitudinal slits in the cylinder. In a particular beneficial embodiment, provision is made for an air accumulation space to be arranged in the blowing duct between the nozzle wall and a sealing wall which is located at the cylinder. In this manner, a very uniform pressurization of the nozzles is achieved.

The air accumulation space is divided by an intermediate plate into two chambers which are allocated to the upper and lower longitudinal slits of the sealing wall and the upper and lower nozzles in the nozzle wall, respectively. In this context, the cylinder, in turn, is situated in a longitudinal duct which is filled with compressed air and connected to a compressed air accumulator.

The rotating cylinder has the advantage that a uniform pressure is present at the nozzles over the entire production width even when working with larger production widths.

The blow-out angles of the nozzles of both nozzle rows are preferably equal whereby an equal deflection of the filament sheet is achieved in both directions. The blow-out angles can be 10 to 60°, preferably 45°.

For further supporting the nonwoven fabric deposition method, an adjustable mechanical air guide for controlling the direction of the air flow can be provided beneath the blowing duct. This air guide can be composed of swivelling wing flaps or also of Coander dishes which enable the filament sheet to be moved to and fro in the production direction.

To support the air guidance, in the preferred embodiment provision is made for an adjustable air guiding plate to be mounted opposite the blowing duct at the other front of the filament sheet. This air guiding plate supports the direction of the lateral air flow, and the lateral swinging motion of the filament sheet can be adjusted to be more intense or less intense by bringing the air guiding plate closer to the blowing duct or moving it away therefrom.

FIG. 1 schematically represents four individual steps A, B, C, and D of the method. The front walls of a blowing duct 3 are illustrated by vertical lines 1. 2 denotes an air guiding plate. Dots 4 are intended to represent the individual filaments of the filament sheet. Arrow 5 indicates the moving direction of the deposition belt. Curved arrows 6 and 7 represent the flow direction of the air flow.

When working with the method chosen in the example, the filament sheet of filaments 4 is moved toward the right at one time, compare step B, and toward the left at another time, compare step D, as viewed from ts production direction. The air flow is stopped between these movements so that the filament sheet can align vertically as shown in steps A and C. From blowing duct 3, which is located at the rear front of the filament sheet as viewed in the production direction, the air is periodically blown out toward the right at one time, compare step B, and toward the left at another time, compare step D, from the nozzles provided for this. At the front face of the filament sheet, air guiding plate 2 is located which is provided with an adjusting mechanism and whose distance from blowing duct 3 is adjustable.

At the bottom of the Figure, the deposition of an individual filament 4 is schematically drawn in, and it is discernible that filament 4, while being deposited, carries out a movement which produces more or less the shape of an eight on the support.

Figure 2:
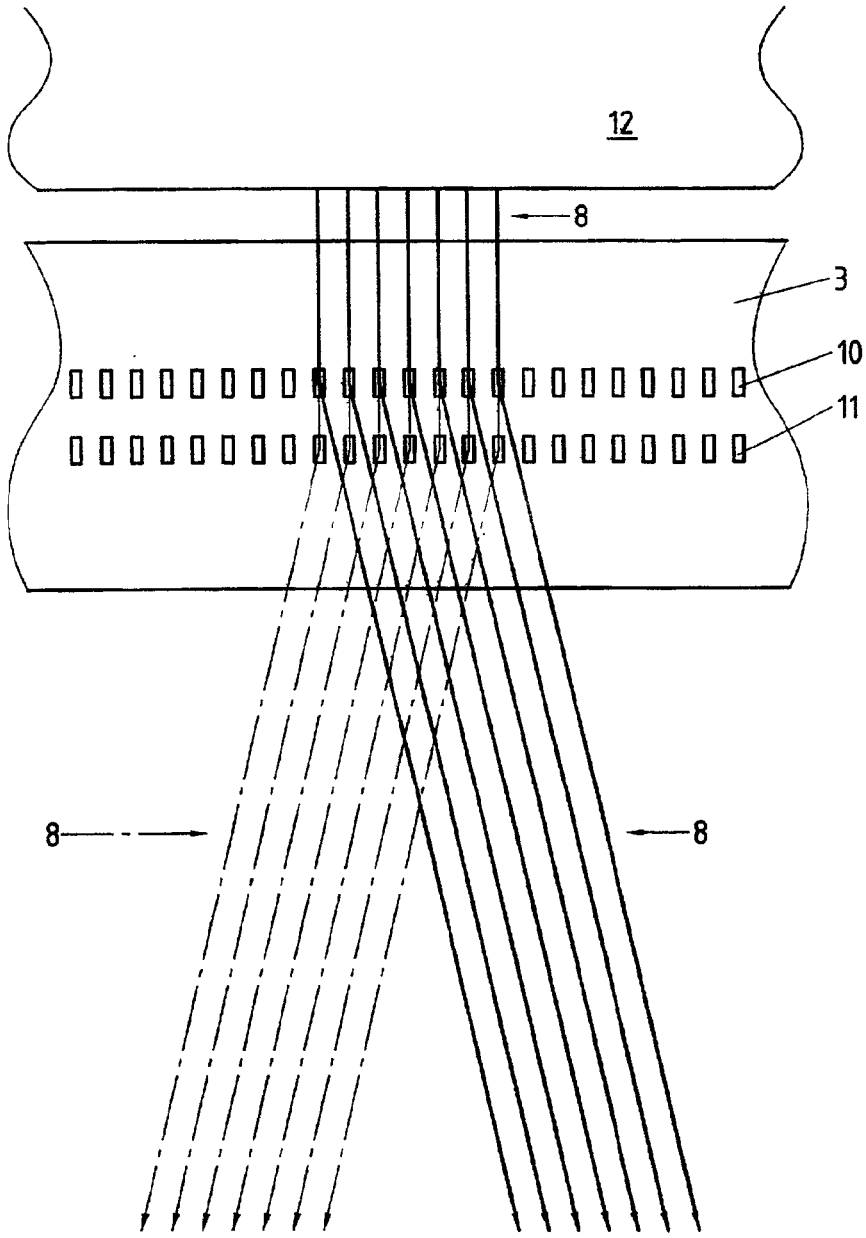
FIG. 2 is a schematic representation of the blowing duct with deflected filament sheet according to the invention.

FIG. 2 depicts blowing duct 3 including air-outlet nozzles 10 and 11 which are superposed in rows. Filament sheet 8 which emerges from drawing duct 12 is initially deflected toward the right by the air flow issuing from nozzles 10, which is indicated by the solid lines of filament sheet 8. Subsequent to cutting the air flow, filament sheet 8 aligns vertically again and, in the further step, is deflected in the opposite direction by the air flow from air-outlet nozzles 11, which is indicated by the dotted lines of filament sheet 8. It should be mentioned that this representation reproduces the principle of the method only schematically.

Figure 3:
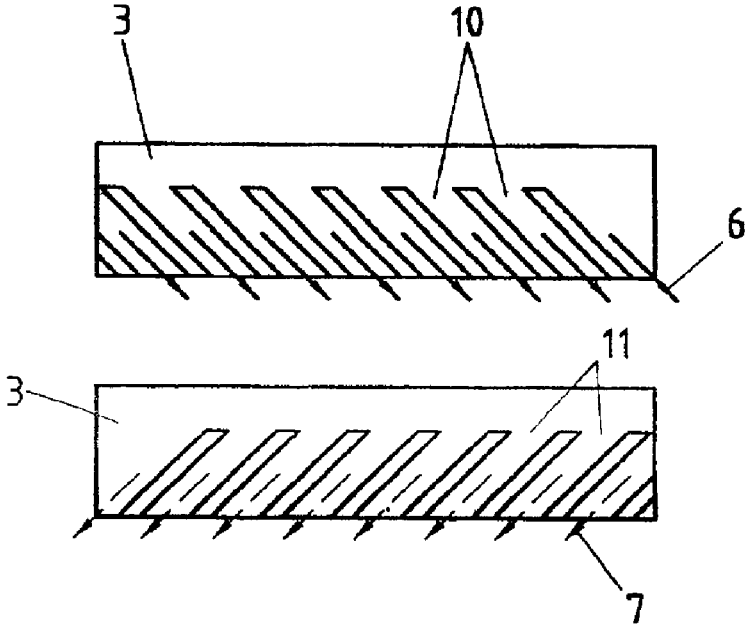
FIG. 3 shows a top view of air-outlet nozzles of the blowing duct.

FIG. 3 shows a top view of nozzles 10 and 11 of blowing duct 3. Arrows 6 and 7 indicate the flow direction of the air flow. Blowing duct 3 is equipped with an intermediate plate which separates the respective spaces for nozzles 10 and 11 from each other. Because of this, it is possible for each space of blowing duct 3 to be separately supplied with compressed air.

Figure 4:
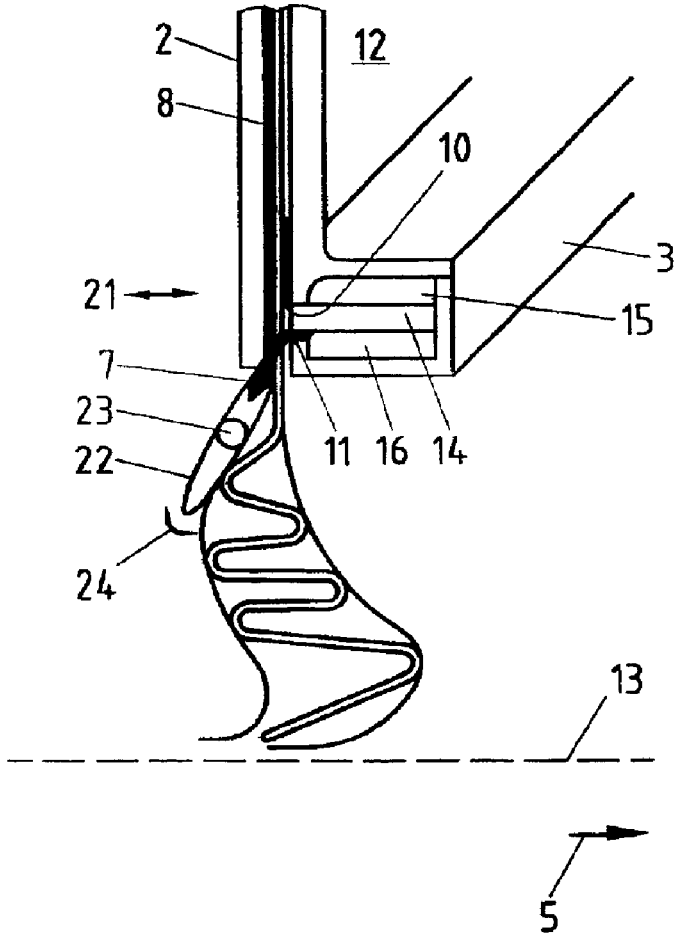
FIG. 4 shows the drawing duct with the blowing duct and air guides in a partially perspective view.

FIG. 4 represents an arrangement of drawing duct 12, blowing duct 3 and deposition belt 13. Blowing duct 3 features nozzles 10 and 11 from which air flows 6 and 7 emerge. Intermediate plate 14 divides blowing duct 3 into two chambers 15 and 16 via which the compressed air is supplied to nozzles 10 and 11. Air guiding plate 2 is mounted opposite blowing duct 3 and can be moved via suitable adjusting mechanisms in the direction of blowing duct 3, which is indicated by double arrow 21. Provided beneath air guiding plate 2 is wing flap 22 which can swivel about axis 23 as is indicated by arrow 24. Filament sheet 8 which emerges from drawing duct 12 is moved to and fro laterally crosswise by the air flows from air-outlet nozzles 10 and 11. Wing flap 22 additionally swings filament sheet 8 to and fro in the production direction. The nonwoven fabric forming on deposition belt 13 has an extraordinarily high uniformness and distribution of weight per unit area.

Figure 5:
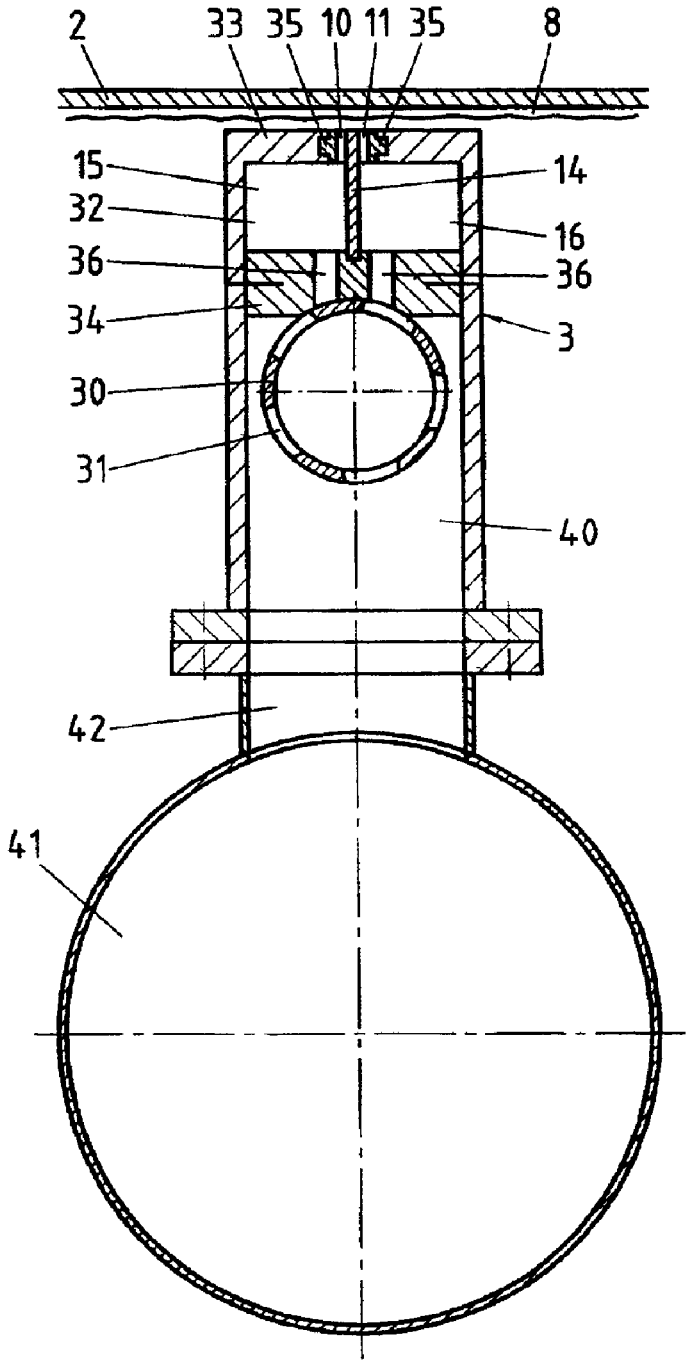
FIG. 5 shows the blowing duct with an air accumulation space.

FIG. 5 depicts the preferred embodiment in which hollow cylinder 30 which is provided with slits 31 is situated in blowing duct 3 in a separate longitudinal duct 40. Between nozzle wall 33 of blowing duct 3 and a sealing wall 34 on which cylinder 30 engages, an air accumulation space 32 exists which is separated into two chambers 15 and 16 by intermediate plate 14. In nozzle wall 33, nozzles 10 and 11 are superposed in rows. They are formed by corrugated sheet-like inserts 35 having corrugations which run at an angle to their longitudinal direction (to the machine width). Inserts 35 are replaceable. Sealing wall 34 features superposed longitudinal slits 36 which correspond to longitudinal slits 31 in cylinder 30. Longitudinal slits 31 and 36 are matched to each other in such a manner that the compressed air is supplied either only to upper chamber 15 or to lower chamber 16. In the process, intermediate pauses can be inserted via the covering of slits 36 by the cylinder wall, the pauses allowing filaments 8 to align vertically. Depending on the proportion of longitudinal slits 31 and the cylinder wall and slits 36 in sealing wall 34, the air flow from longitudinal duct 40 into chambers 15 and 16 can be varied. Via several connection pieces 42, longitudinal duct 40 is connected to a compressed air accumulator 41 extending parallel to longitudinal duct 40.

What is claimed is:

1. A method for producing a spunbonded nonwoven fabric by extruding a linear sheet of filaments, arranged side by side in parallel and laterally crosswise to a production direction, in the form of a curtain from a plurality of spinning capillaries, comprising the steps of: aerodynamical pulling off and drawing of a filament sheet (8) which one of emerges from a drawing duct channel (12) and is pulled off a spool, wherein the filament sheet is moved laterally crosswise to the production direction by an air flow having periodically changing directions, the air flow being oriented alternately at an angle toward the filament sheet (8) as viewed in the horizontal plane, wherein air pauses exist between the air flows.

2. A method for producing a spunbonded nonwoven fabric by extruding a linear sheet of filaments, arranged side by side in parallel and laterally crosswise to a production direction, in the form of a curtain from a plurality of spinning capillaries, comprising the steps of: aerodynamical pulling off and drawing of a filament sheet (8) which one of emerges from a drawing duct channel (12) and is pulled off a spool, wherein the filament sheet is moved laterally crosswise to the production direction by an air flow from a blowing duct having periodically changing directions, the air flow being oriented alternately at an angle toward the filament sheet (8) as viewed in the horizontal plane.

wherein the blowing duct is arranged beneath the drawing duct channel and at least one of in front of and behind the filament sheet, the blowing duct having air-outlet nozzles which are aligned at an angle toward the filament sheet as viewed in the horizontal plane.

3. The method for producing a spunbonded nonwoven fabric according to claim 2, wherein the blow-out direction is oriented perpendicularly toward the filament sheet (8).

4. The method for producing a spunbonded nonwoven fabric according to claim 2, wherein the airflow is directed toward the filament sheet (8) from at least one of the front and the rear thereof.

5. The method for producing a spunbonded nonwoven fabric according to claim 2, wherein, subsequent to the air-flow movement, the filament sheet (8) is additionally deflected by periodically moving flow-guide surfaces.

6. A method for producing a spunbonded nonwoven fabric by extruding a linear sheet of filaments, arranged side by side in parallel, in the form of a curtain from a plurality of spinning capillaries, comprising the steps of: aerodynamical pulling off and drawing of a filament sheet (8) which emerges from a drawing duct channel (12) or which is pulled off a spool, wherein the filament sheet is moved laterally crosswise by an air flow having periodically changing directions, the air flow being oriented alternately at an angle toward the filament sheet (8) as viewed in the horizontal plane, wherein the blow-out angle in the horizontal plane is 15°.

7. The method for producing a spunbonded nonwoven fabric according to claim 6, wherein the blow-out direction in the vertical plane is directed at an angle downwards toward the filament sheet (8).

8. The method for producing a spunbonded nonwoven fabric according to claim 7, wherein the blow-out angle in the vertical plane is 15°.

* * * * *